US009486094B2

(12) United States Patent
Killian

(10) Patent No.: US 9,486,094 B2
(45) Date of Patent: Nov. 8, 2016

(54) NOTIFICATION BOARD AND LABELING APPARATUS

(71) Applicant: Travis Killian, New York, NY (US)

(72) Inventor: Travis Killian, New York, NY (US)

( * ) Notice: Subject to any disclaimer, the term of this patent is extended or adjusted under 35 U.S.C. 154(b) by 0 days.

(21) Appl. No.: 14/492,703

(22) Filed: Sep. 22, 2014

(65) Prior Publication Data

US 2015/0007465 A1 Jan. 8, 2015

Related U.S. Application Data

(63) Continuation of application No. 13/439,236, filed on Apr. 4, 2012, now Pat. No. 8,839,539.

(51) Int. Cl.

| | |
|---|---|
| ***A47G 1/06*** | (2006.01) |
| ***G09F 1/12*** | (2006.01) |
| ***G09F 7/10*** | (2006.01) |
| ***G09F 7/18*** | (2006.01) |

(52) U.S. Cl.

CPC ..... *A47G 1/065* (2013.01); *G09F 1/12* (2013.01); *G09F 7/10* (2013.01); *G09F 7/18* (2013.01); *G09F 2007/1843* (2013.01)

(58) Field of Classification Search

CPC ..... A47G 1/062; G09F 1/12; G09F 7/10
See application file for complete search history.

(56) References Cited

U.S. PATENT DOCUMENTS

| | | | | | |
|---|---|---|---|---|---|
| 1,830,506 | A * | 11/1931 | Cowing | G09B 29/00 | 40/607.15 |
| 3,371,439 | A * | 3/1968 | Smith | G03B 21/64 | 40/490 |
| 4,553,344 | A * | 11/1985 | Rubin | A47G 1/065 | 40/735 |
| 4,679,341 | A * | 7/1987 | Goldman | G09F 7/10 | 40/490 |
| 4,860,468 | A * | 8/1989 | Cliborn | G09F 1/12 | 40/124.2 |
| 5,186,566 | A * | 2/1993 | Cameron | G03B 21/64 | 206/449 |
| 5,419,062 | A * | 5/1995 | Polinski | G09F 7/10 | 40/124.4 |
| 5,651,202 | A * | 7/1997 | Hewitt | G09F 7/10 | 206/39 |
| 2010/0251585 | A1* | 10/2010 | Schaefer | A47G 1/065 | 40/735 |

* cited by examiner

*Primary Examiner* — Gary Hoge
(74) *Attorney, Agent, or Firm* — James M. Smedley LLC; James Michael Smedley, Esq.

(57) ABSTRACT

The present invention generally relates to a notification boards. Specifically, this invention relates to a notification board configured to organize and display papers, photographs and other documents for viewing. Embodiments of the present invention may include a labeling apparatus configured to describe or otherwise detail the displayed contents of the notification board.

18 Claims, 8 Drawing Sheets

NOTIFICATION BOARD AND LABELING APPARATUS

CROSS REFERENCE TO RELATED APPLICATIONS

This application is a continuation-in-part of U.S. patent application Ser. No. 13/439,236 filed on Apr. 4, 2012 the entire disclosure of which is incorporated herein by reference.

FIELD OF THE INVENTION

The present invention generally relates to notification boards. Specifically, this invention relates to a notification board configured to organize and display papers, photographs and other documents for viewing. Embodiments of the present invention may include a labeling apparatus configured to describe or otherwise detail the displayed contents of the notification board.

BACKGROUND OF THE INVENTION

The use of notification boards or announcement boards has been ubiquitous in all manners of settings. From schools, workplaces, government buildings and universities to homes and public places, the use of notification boards for the publishing of content relevant to passersby is common practice across all walks of life.

One main issue with standard notification boards is that they are commonly a place where there is no organization or restrictions on the placement of content. Typically consisting of corkboard, magnetic materials or other simple means allowing for documents to be retained upon a surface, notification boards commonly become unorganized messes of content layered upon content with no separation between the various documents and no way to know how long documents have been residing on the notification board or provide other identifying information. Additionally, especially in the case of notification boards that use corkboard or similar material, the attachment means used, such as thumbtacks and staples, frequently damage both the notification board and the documents themselves.

Another issue with standard notification boards is that since there is no demarcation between the documents or space where documents should be placed, individuals end up stacking documents and obscuring the documents previously placed by others. This can commonly lead to messy, unorganized notification boards that actually end up dissuading passersby from coming to view the content placed thereupon.

Therefore, there is a need in the art for a notification board that provides the ability to organize and display documents for viewing and further provide an easy and convenient method for allowing the removal of hard to retrieve documents from each distinct viewing area. These and other features and advantages of the present invention will be explained and will become obvious to one skilled in the art through the summary of the invention that follows.

SUMMARY OF THE INVENTION

Accordingly, embodiments of the present invention are directed to providing a notification board configured to organize and display papers, photographs and other documents for viewing. Embodiments of the present invention may include a labeling apparatus configured to describe or otherwise detail the displayed contents of the notification board.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
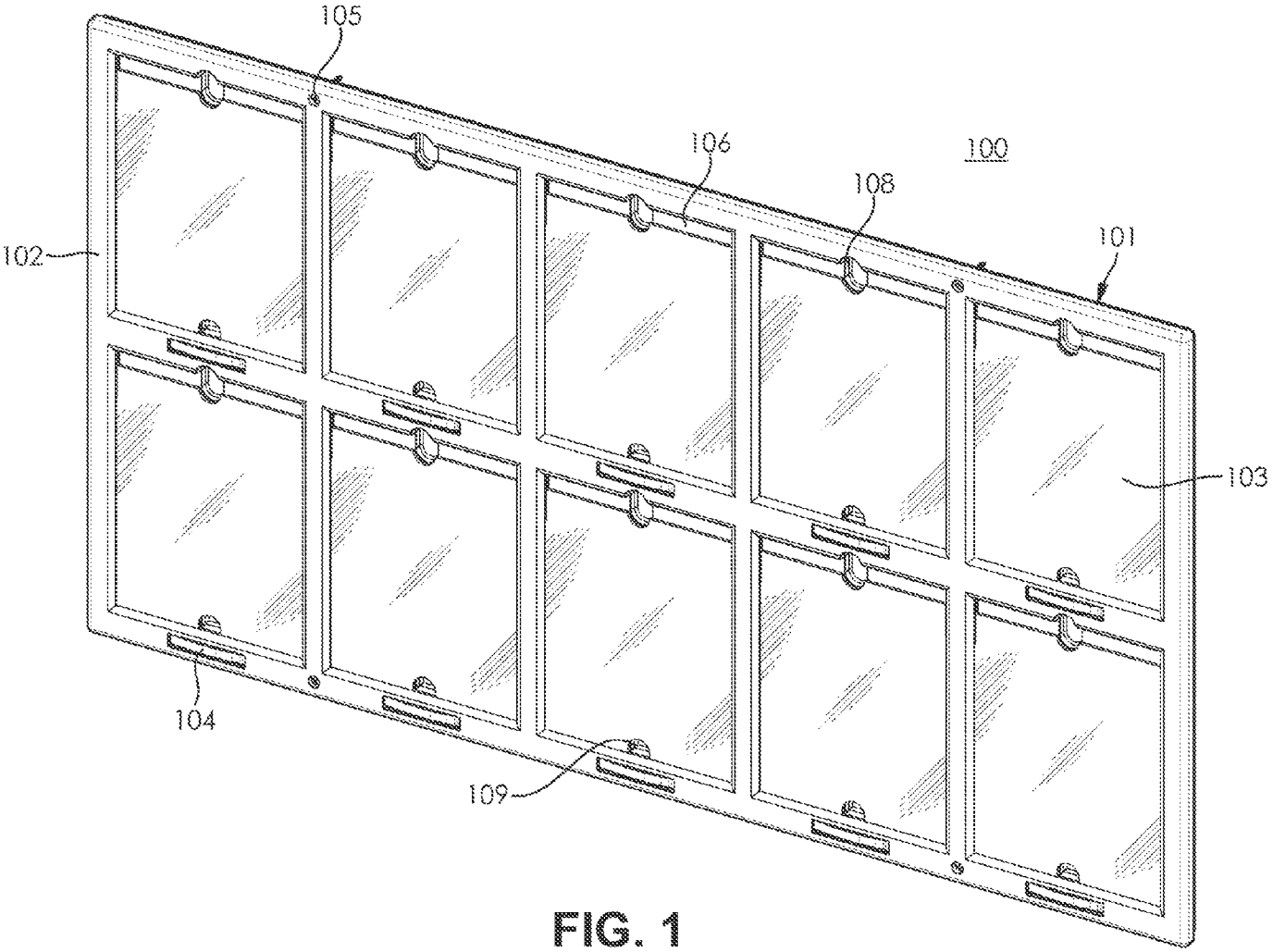
FIG. 1 is a perspective view of a notification board in accordance with an embodiment of the present invention.

The present invention generally relates to notification boards. Specifically, this invention relates to a notification board configured to organize and display papers, photographs and other documents for viewing. Embodiments of the present invention may include a labeling apparatus configured to describe or otherwise detail the displayed contents of the notification board.

According to an embodiment of the present invention, a notification board includes a back frame portion, a front frame portion comprising one or more divider sections, one or more display panels and one or more tension means. Combined, these components form a notification board that allows for the retention and display of multiple documents in an organized manner.

According to an embodiment of the present invention, the back frame portion is comprised of a rear side and a front side. The rear side of the back frame portion is configured to be attached to a surface via one or more attachment means. In a preferred embodiment, the attachment surface would be a wall or other solid surface that would provide the ability to retain weight of the notification board and its content. Common surfaces include walls, posts, mounting brackets and hanging display brackets. One of ordinary skill in the art would appreciate that there are numerous surfaces embodiments of the present invention could be utilized with, and embodiments of the present invention are contemplated for attachment to any surface.

According to an embodiment of the present invention, the back frame portion is formed from a single piece of material. In a preferred embodiment, the back frame portion is made from a plastic. In an alternate embodiment, the back frame is made from a metal. One of ordinary skill in the art would appreciate that the back frame portion could be made from a variety of materials, and embodiments of the present invention are contemplated for use with any such material.

According to an embodiment of the present invention, the attachment means are configured to be received through a front side of the notification board and into or onto the attachment surface in a manner that affixes the notification board to the surface. Attachment means include, but are not limited to, screws, nails, pins, nuts and bolts, tacks and other fasteners. One of ordinary skill in the art would appreciate that there are numerous attachment means that could be utilized with embodiments of the present invention, and embodiments of the present invention are contemplated for use with any attachment means.

In other embodiments, attachment means are not required to be received through the front side of the notification board. For instance, the attachment means could be comprised of adhesives capable of securing the rear side of the back frame portion to the attachment surface. One of ordinary skill in the art would appreciate there are numerous attachment means that could be utilized in this manner, and embodiments of the present invention are contemplated for use with any form of attachment means.

According to an embodiment of the present invention, the front frame portion of the notification board is comprised of one or more divider sections. Each divider section is formed by a plurality of bars forming a shape that when connected to the front side of the back frame portion of the notification board, a retention space is formed. In a preferred embodiment, the divider sections are square or rectangular and form a space ideally shaped to retain one or more documents. The documents may be, for instance, papers, letters, legal notices, photographs, flyers or advertisements. One of ordinary skill in the art would appreciate that embodiments of the present invention could be utilized to retain any manner of documents, and embodiments of the present invention are contemplated for use with the retention of any type of document.

According to an embodiment of the present invention, the back frame portion is configured with one or more display area depressions. In a preferred embodiment, each of the display area depressions is configured to correspond to one of the divider sections of the front frame portion. The display area depressions may be formed in the back frame portion through a molding process or through a pressing process. Furthermore, in the preferred embodiment, each display area depression will be configured to contain a document, flyer, or similar item when combined together with the front frame portion and the display panel. One of ordinary skill in the art would appreciate that there are many suitable designs for display area depression, and embodiments of the present invention area contemplated for use with any such display area depression.

According to an embodiment of the present invention, the one or more display area depressions may further include finger slot depressions located at the top, bottom, or top and bottom of each display area depression. In a preferred embodiment, the finger slot depressions allow a user to more easily grasp and maneuver a document that is in place behind the display panel. One of ordinary skill in the art would appreciate that there are numerous ways to configure a finger slot depression, and embodiments of the present invention are contemplated for use with any such configuration.

According to an embodiment of the present invention, the back frame portion is configured with a network of structural ribbing. In a preferred embodiment, the structural ribbing provides rigidity to the back frame portion. In the preferred embodiment, the network of structural ribbing is formed in the back frame portion through the molding process that forms the back frame portion. In alternate embodiments, the network of structural ribbing is formed in the back frame portion stamped or pressed into the material forming the back frame portion. One of ordinary skill in the art would appreciate that there are numerous useful designs for a network of structural ribbing in the back frame portion, and embodiments of the present invention are configured for use with any such design.

According to an embodiment of the present invention, the back frame portion may be substantially flat and without any structural ribbing. In a preferred embodiment, the back frame portion would be a single piece of material configured to engage with the front frame portion. The preferred embodiment may include one or more display area depressions, as well as finger slot depressions. One of ordinary skill in the art would appreciate there are numerous suitable designs for a substantially flat back frame portion, and embodiments of the present invention are contemplated for use with any such design.

According to an embodiment of the present invention, given the shape and size of the divider sections and the space formed therein, documents retained in the space of the divider section are maintained in an upright and clearly viewable manner. Advantageously, documents are prevented from folding over or otherwise becoming unreadable due to positioning or placement.

According to an embodiment of the present invention, one or more display panels are secured in between the divider sections of the front frame portion and the front side of the back frame portion of the notification board. This display panel works to keep the documents in place within the retention space defined between the divider sections and the front side of the back frame portion. In a preferred embodiment, these components work to form a retention space that is enclosed on all sides except for an opening on top that allows for the easy insertion and removal of documents into the retention space. Ideally, the display panels are comprised of a transparent or semi-transparent material, such as polycarbonate plastic (for example, Lexan®), glass or acrylic glass (such as Plexiglas®). However, in certain embodiments, it may be desirable to have non-transparent materials used. One of ordinary skill in the art would appreciate there are numerous materials of various transparency from which the display panels could be constructed from, and embodiments of the present invention are contemplated for use with display panels of any material and any transparency.

According to an embodiment of the present invention, the one or more display panels may be configured with one or more finger slot cut-outs. In a preferred embodiment, the finger slot cut-outs allow a user to more easily grasp and maneuver a document that is in place behind the display panel. In the preferred embodiment, the finger slot cut-outs on the display panels are configured to align with the finger slot depressions of the display area depression. One of ordinary skill in the art would appreciate that there are numerous ways to configure a finger slot cut-out, and embodiments of the present invention are contemplated for use with any such configuration.

According to an embodiment of the present invention, each retention space has an open top portion formed by a curved portion located at the top of said divider section that forms said retention space. In this manner, documents may be easily inserted and removed from the top of each retention space. In other embodiments, there are no openings and documents are inserted and retrieved via other means described below.

According to an embodiment of the present invention, each divider section and display panel combination is in contact with a tension means. The tension means is configured to provide a force on the display panel to urge the display panel towards a closed position. Users of the notification board may apply a counter force in the opposite direction to move the display panel to an open position. In a closed position, the retention space formed between the display panel, back frame portion and divider section is ideal for retaining documents therein. In an open position, easy access to documents within the retention space is provided. This is useful when documents that are placed into the retention space are otherwise hard to retrieve.

According to an embodiment of the present invention, the tension means may be a leaf spring, coil spring, weighted element, magnetic element or other means for urging the display panel towards a closed position. One of ordinary skill in the art would appreciate that there are numerous tension means that could be used with embodiments of the present invention, and embodiments of the present invention are contemplated for use with any tension means.

According to an embodiment of the present invention, the notification board could be further comprised of one or more labeling components. The labeling component is configured to allow for users of the notification board to identify and label the contents of the various divided sections and the documents contained therein. In a preferred embodiment of the present invention, the labeling component is comprised of a curved label projection and a label opening. In the preferred embodiment, the curved label projection is configured on the back frame portion and the label opening is configured in the front frame portion, with the label opening being further configured to fit closely over the curved label projection. In this preferred embodiment, a label is inserted on one side of the curved label projection in a space that is created by the joining of the label opening around the curved label projection. The label is then bent around the curved label projection and inserted at the equivalent space on the other side of the curved label projection. The arc of the curved label projection makes the label stay in place with compression force occurring from the label opening that is above the curved label projection. In a preferred embodiment of the present invention, the notification board has an equal number of labeling components and divider sections, allowing for each divided section to be appropriately labeled.

According to an embodiment of the present invention, the front frame portion and the various divider sections form a single integrated piece. The entire single integrated piece is configured to be attached to the back frame portion via one or more attachment means. Commonly, screws or plastic fusing techniques may be utilized. However, one of ordinary skill in the art would appreciate there are numerous attachment means that may be utilized to secure the single integrated front frame portion to the back frame portion of the notification board, and embodiments of the present invention are contemplated for use with any attachment means.

According to an embodiment of the present invention, the notification board is further comprised of one or more locking elements. The locking elements may, for instance, be comprised of a first element attached to a display panel and a second element attached to the front frame portion of the notification board. The locking element may be utilized to further secure the display panel in a closed position or to otherwise protect documents contained within the notification board. Locking elements may include, but are not limited to, latches, key locks, combination locks, hook and loops, tie down elements and tongue and groove elements. One of ordinary skill in the art would appreciate that there are numerous locking elements that may be utilized with embodiments of the present invention, and embodiments of the present invention are contemplated for use with any locking elements.

Exemplary Embodiments

Turning now to FIG. 1, a perspective view of an exemplary embodiments of the present invention is shown. In this FIG. 1, a notification board 100 with a back frame portion 101 and a front frame portion 102 that, in combination, form ten divider sections. In this embodiment, the back frame portion 101 also includes a finger slot depression 108 at the top of each of the ten divider sections. Additionally in FIG. 1, the notification board 100 is comprised of ten display panels 103, ten labeling components 104 and 4 attachment means 105. The display panels 103 is also formed with a finger slot cut-out 109. In this embodiment, each of the divider sections 102 is the same size. This goes for the labeling components 104 and display panels 103 as well. One of ordinary skill in the art would appreciate that the divider sections 102, labeling components 104 and display panels 103 may vary in size, providing a notification board 100 with multiple sizes and shapes of divider sections 102 and labeling components 104.

Additionally in FIG. 1, the opening 106 at the top of each divided section can be seen, whereby documents can be inserted into the opening for retention and display in the retention space below. The document can be later removed from the top, or, alternatively, from the bottom by applying an upward force to the display panel, thereby moving the display panel into an open position and allowing for the document to be retrieved from the bottom.

Figure 2:
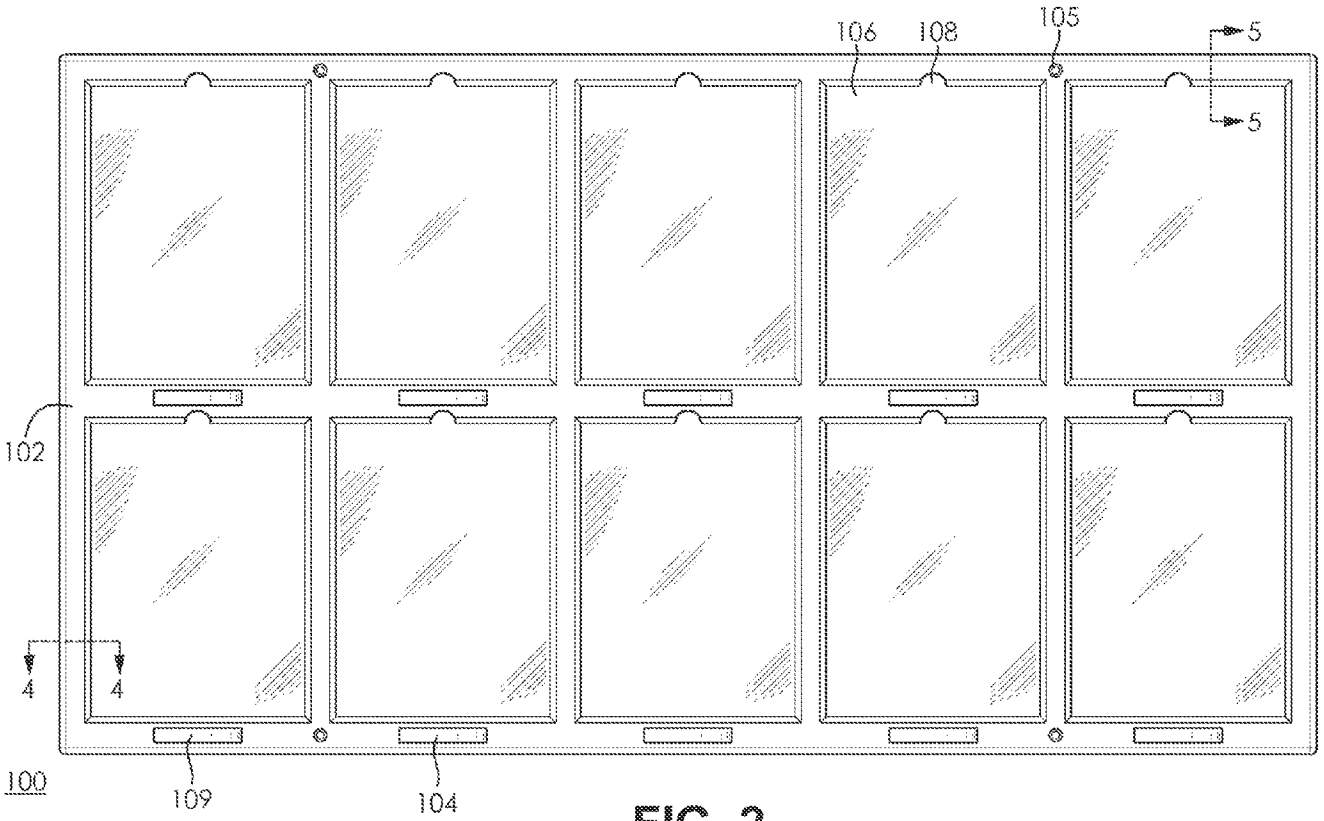
FIG. 2 is a front view of a notification board in accordance with an embodiment of the present invention.
Figure 3:
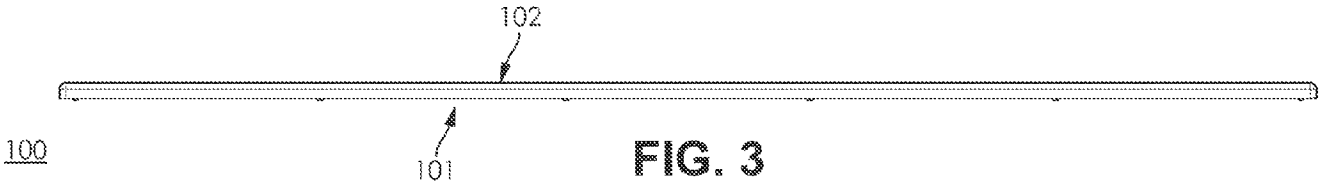
FIG. 3 is a top view of a notification board in accordance with an embodiment of the present invention.

FIGS. 2-3 show alternate views of the embodiment of the notification board as shown in FIG. 1. Again, ten divided sections 102 are shown, with ten display panels 103 ten labeling components 104, and 4 attachment means 105.

Figure 4:
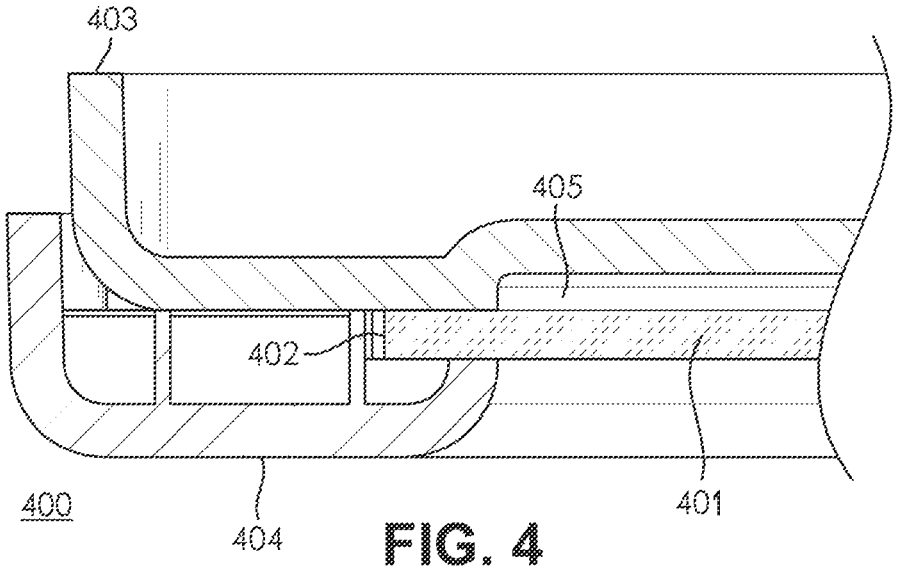
FIG. 4 is a cross-sectional view of a notification board in accordance with an embodiment of the present invention.
Figure 5:
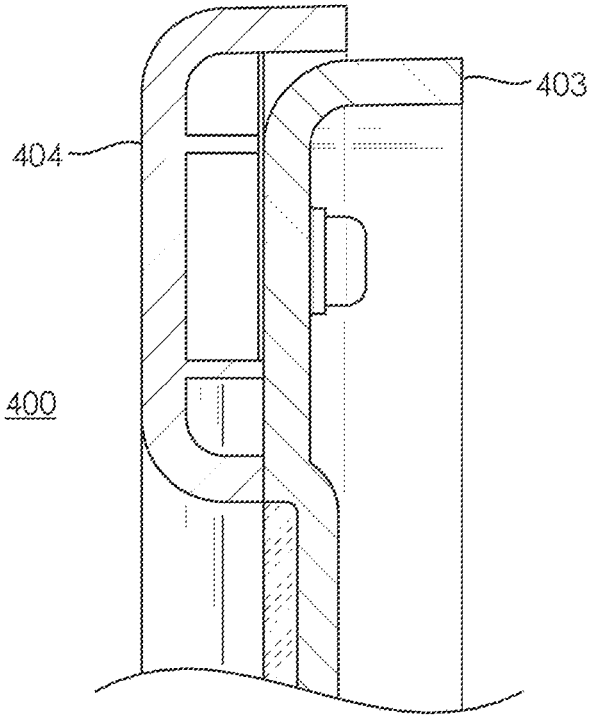
FIG. 5 is a cross-sectional view of a notification board in accordance with an embodiment of the present invention.

FIGS. 4 and 5 shows a cross-sectional view of a divided section with the display panel 401 in a closed position. In an exemplary embodiment, the display panel is received within a channel 402 formed between the back frame portion 403 and the front frame portion 404. This provides stability and control such that the display panel 401 does not wobble or otherwise become loose while the display panel 401 moves up and down within the given space provided in said channel 402. Also shown is the retention space 405 formed behind the display panel 401 which is capable of retaining documents therein while the display panel is in a closed position.

In the embodiment shown in FIGS. 4 and 5, documents may be inserted into the curved portion located at the top or removed from the retention space 405 behind the display panel by reaching in and pulling out the document through the gap provided. It should be noted that, in preferred embodiments of the present invention, when the display panel is in a closed position, documents may be inserted and/or retrieved from the top of the divided section as a curved portion located at the top is left open when the display panel is in the closed position. In an open position, documents may be removed from a gap formed at the bottom of a divided section. The gap is formed when the display panel is slid up within the given space provided in said channel 402. In certain embodiments, the curved portion located at the top may become closed when the display panel is moved into the open position to give access to documents from the bottom.

Figure 6:
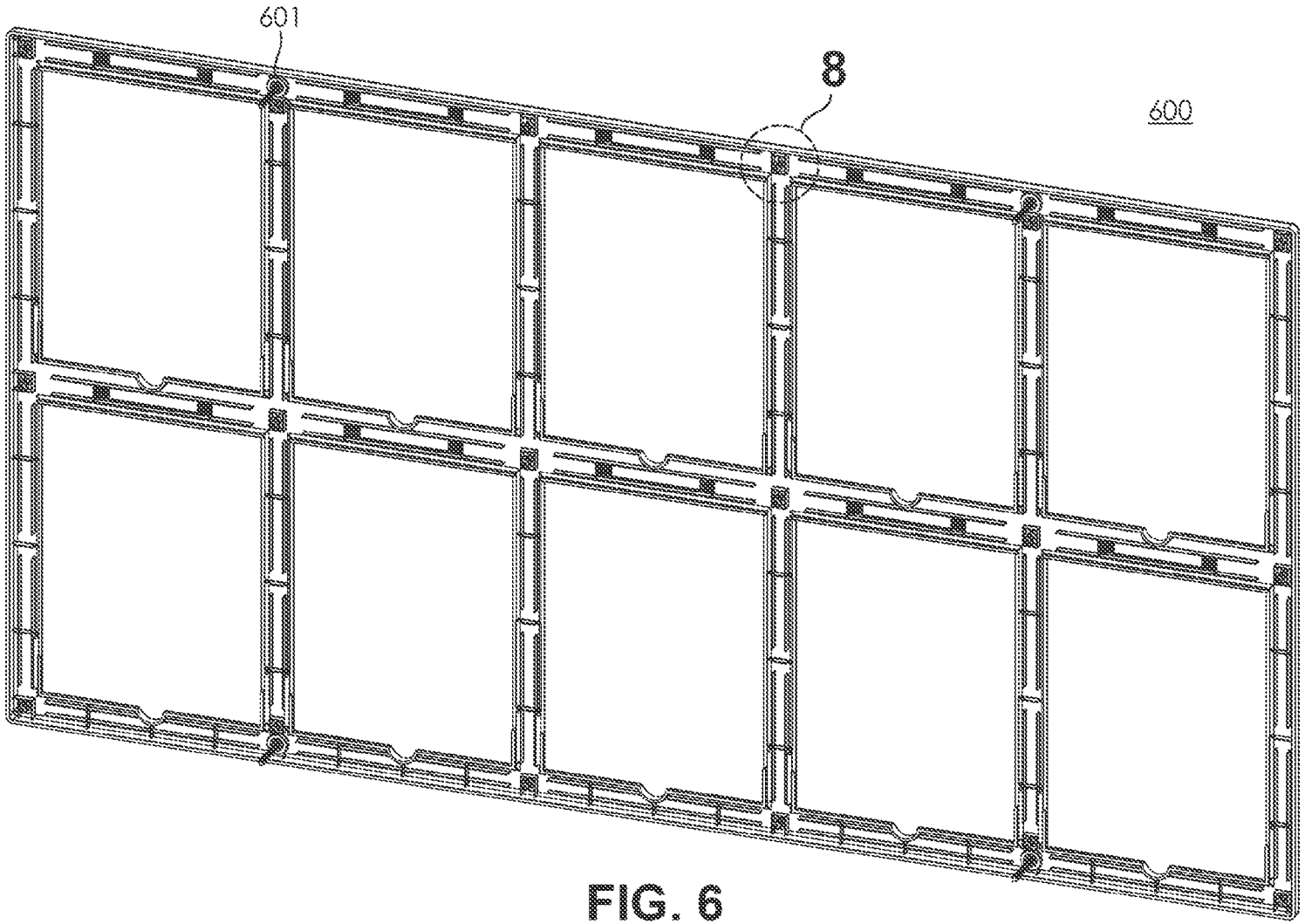
FIG. 6 is a rear perspective view of a front frame portion of a notification board in accordance with an embodiment of the present invention.
Figure 7:
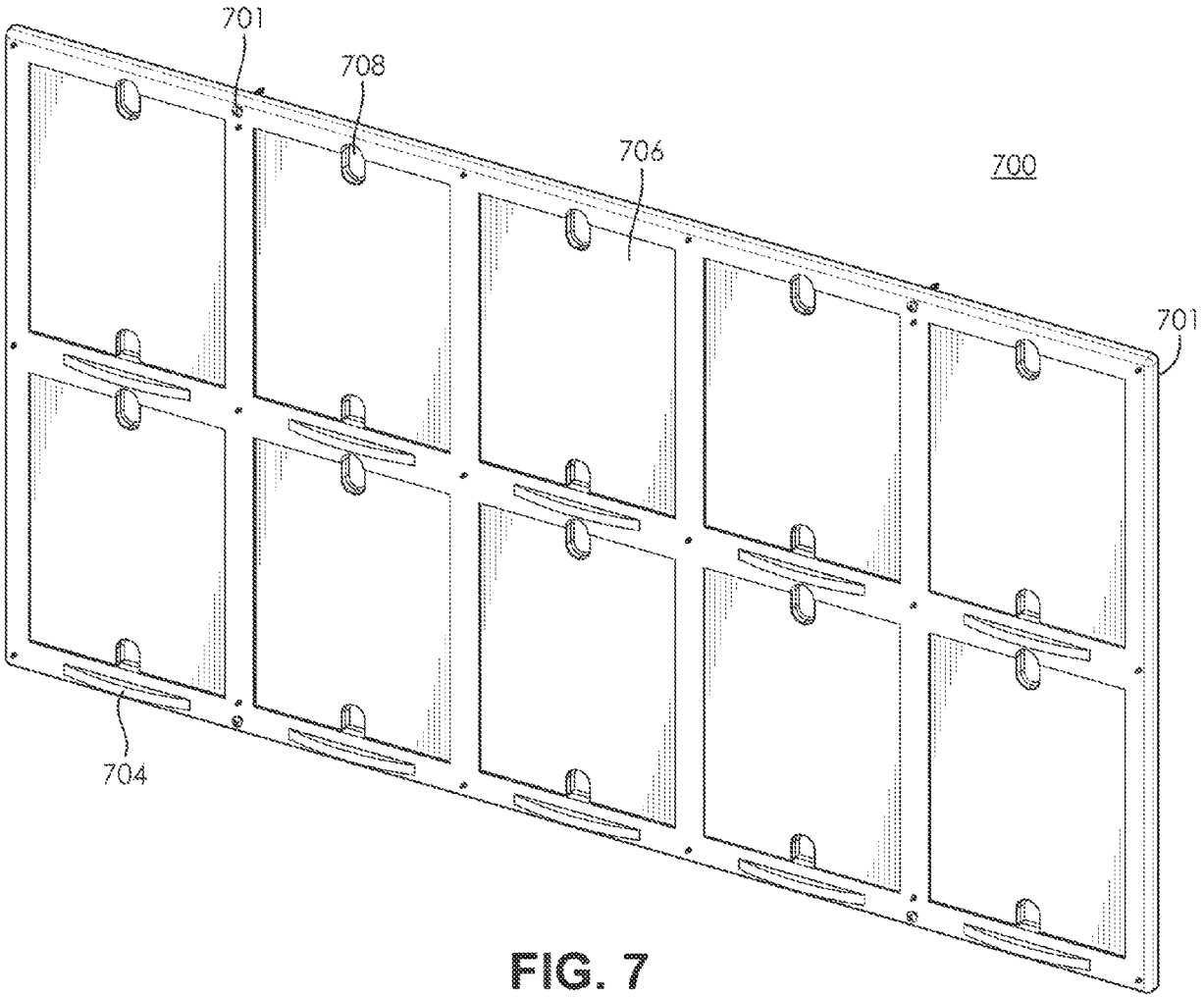
FIG. 7 is a front perspective view of a back frame portion of a notification board in accordance with an embodiment of the present invention.
Figure 8:
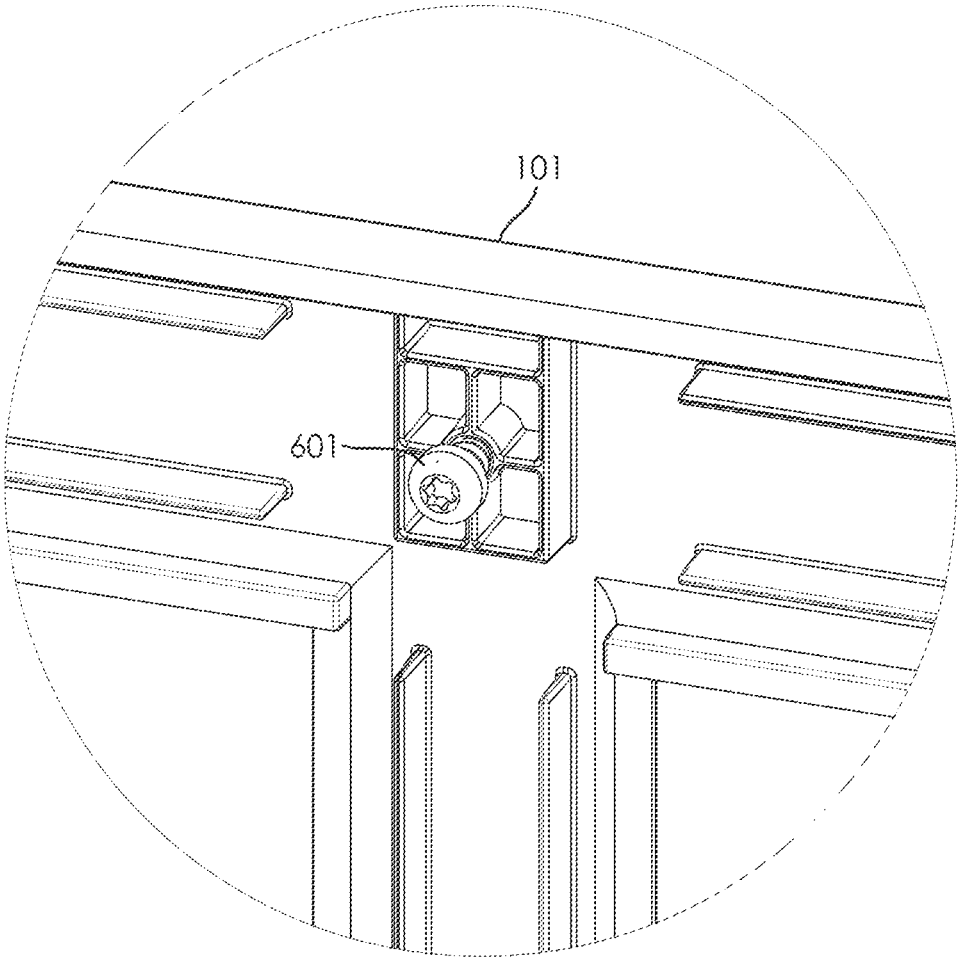
FIG. 8 is a detailed view of an attachment means of a front frame portion of a notification board in accordance with an embodiment of the present invention.

Turning now to FIGS. 6-8 views of the frame of a notification board (front frame portion 600 and back frame portion 700) are shown (FIG. 6 being a rear perspective view of the front frame portion 600, FIG. 7 being a a front perspective view of a back frame portion, and FIG. 8 being a close-up of an attachment means 601 of a front frame portion 600). In these views, the numerous attachment means 601 are shown as well as recessed areas 701 for receiving one or more attachment means 601. These attachment means 601 are used to attach the front frame portion 600 to the back frame portion 700 of the notification board as previously described herein. In a preferred embodiment, the recessed areas 701 are configured to receive a coned area attachment means 601. In certain embodiments of the present invention, no recessed areas 701 are utilized. In the preferred embodiment, each of the display areas 706 is formed with a finger slot depression 708.

Figure 9:
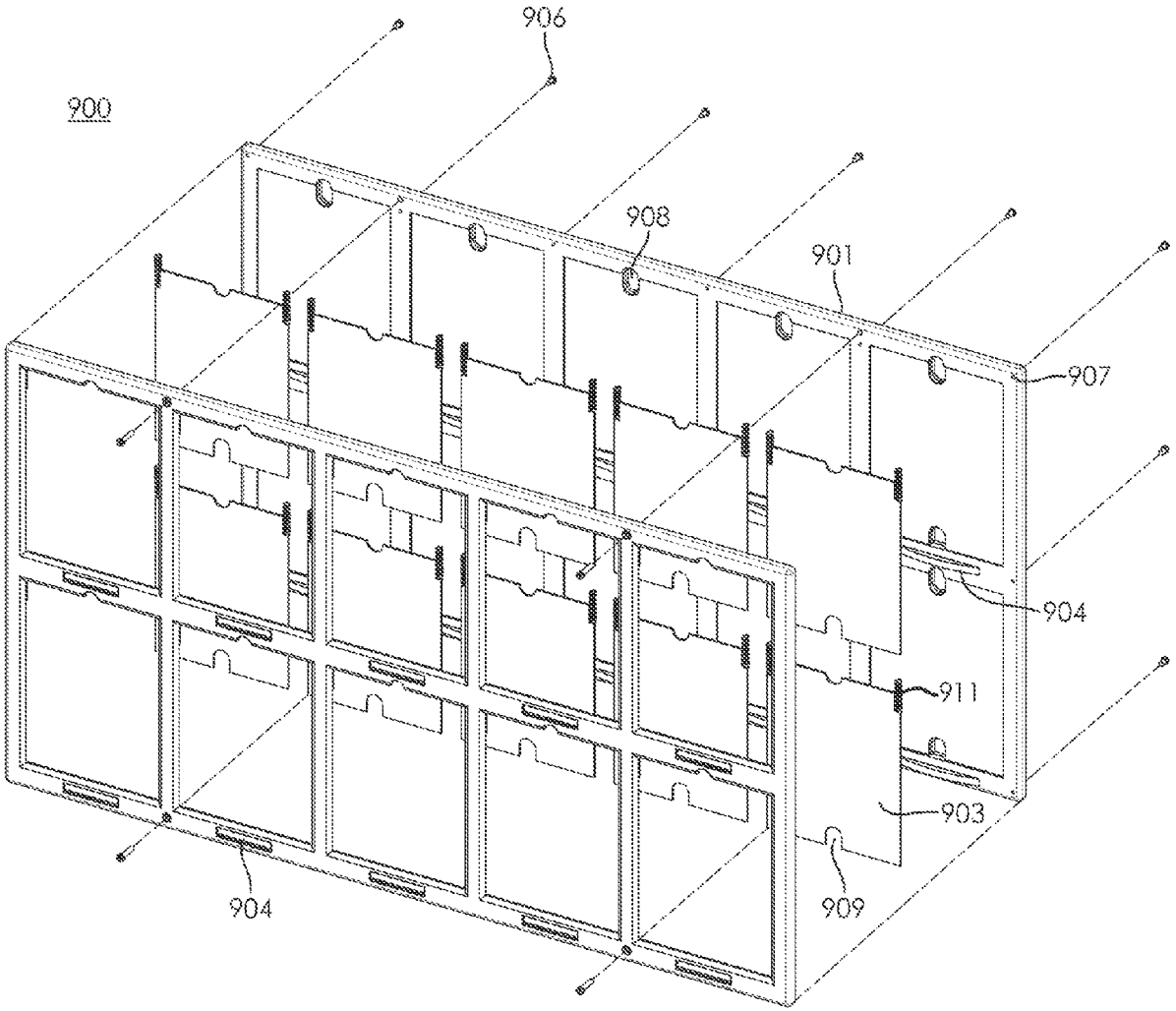
FIG. 9 is an exploded view of a notification board in accordance with an embodiment of the present invention.
Figure 10:
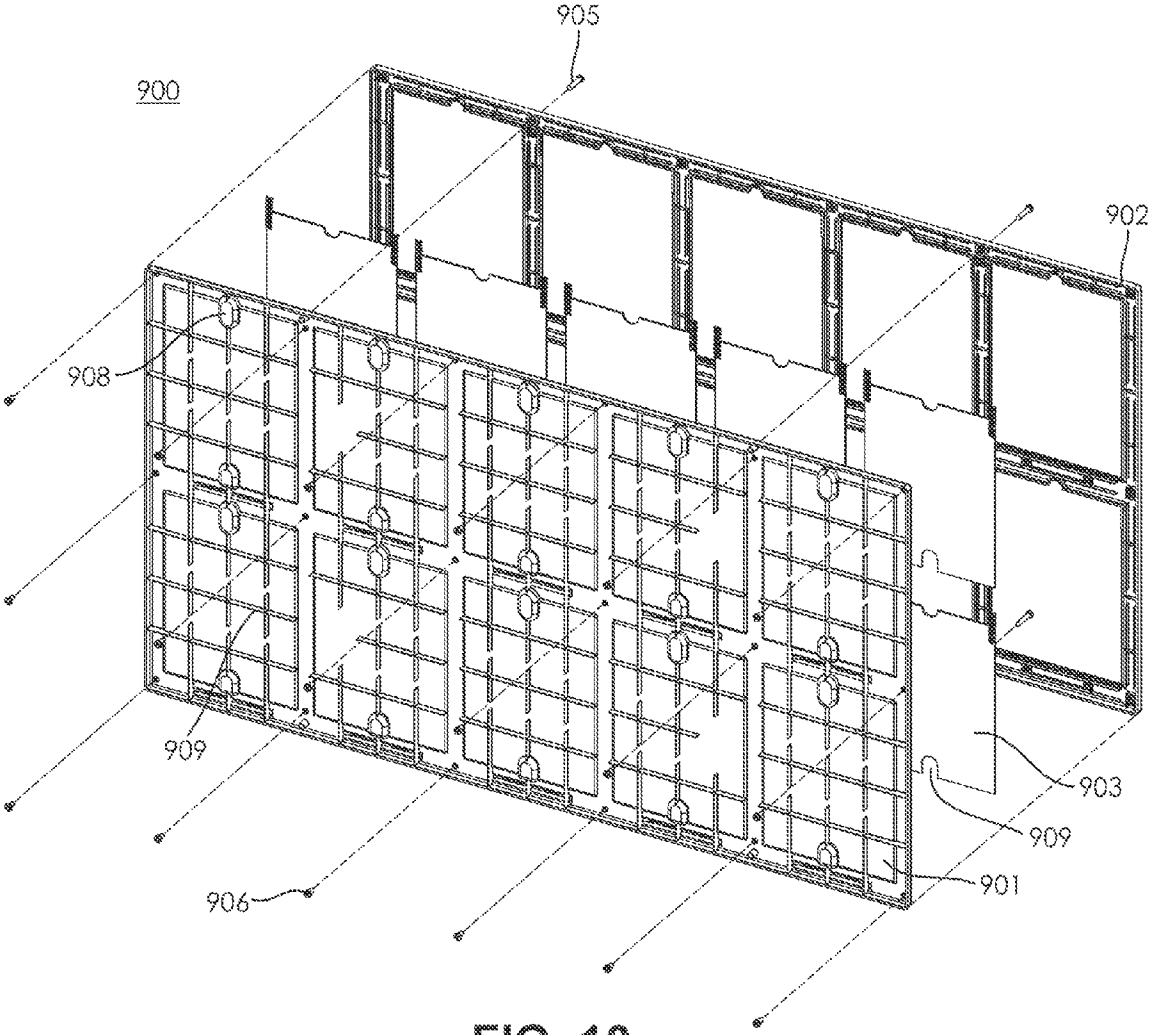
FIG. 10 is an exploded view of a notification board in accordance with an embodiment of the present invention.

FIGS. 9-10 show exploded views of an exemplary embodiment of the notification board 900 of the present invention (FIG. 10 being a front exploded view and FIG. 11 being a rear exploded view). In this embodiment, each of the elements (i.e., back frame portion 901, front frame portion 902, display panel 903, labeling component 904, tension means 911, surface attachment means 905, frame attachment means 906 and frame attachment means recessed receiving areas 907) are aligned in such a manner that when assembled, ten separate divided sections are formed whereby each divided section is capable of retaining one or more documents therein. In this collective manner, documents can be organized and retained in an orderly fashion. In this embodiment, the back frame portion 901 also includes a finger slot depression 908 at the top of each of the ten divider sections and structural ribbing 910 on the back of the back frame portion 901. The display panels 903 are also formed with a finger slot cut-out 909.

It should be noted that the features illustrated in the drawings are not necessarily drawn to scale, and features of one embodiment may be employed with other embodiments as the skilled artisan would recognize, even if not explicitly stated herein. Descriptions of well-known components may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A notification board, said notification board comprising:

a back frame portion comprising a front side formed with one or more display area depressions, a rear side that is configured to be affixed to an attachment surface, and one or more finger slot depressions that are formed in each of said one or more display area depressions;

a front frame portion comprising one or more divider sections, wherein said front frame portion is connected to said front side of said back frame portion;

one or more display panels that are substantially transparent and secured between one of said one or more divider sections of said front frame portion and said front side of said back frame portion; and one or more tension means, wherein each of said one or more tension means is in contact with at least one of said one or more display panels and at least one of said one or more divider sections.

2. The notification board of claim 1, wherein said one or more display panels are further configured with one or more finger slot cut-outs.

3. The notification board of claim 2, wherein each of said one or more finger slot cut-outs correspond to one of said one or more finger slot depressions.

4. The notification board of claim 1, wherein said rear side of said back frame portion is substantially flat.

5. The notification board of claim 1, wherein said rear side of said back frame portion is formed with structural ribbing.

6. The notification board of claim 1, wherein each of said one or more display area depressions correspond to one of said one or more divider sections.

7. The notification board of claim 1, further comprising one or more labeling components, wherein said one or more labeling components is comprised of a curved label projection formed on said back frame portion and a label opening formed on said front frame portion.

8. The notification board of claim 7, wherein there are an equal number of labeling components and divider sections.

9. The notification board of claim 1, wherein said one or more divider sections form a single integrated piece.

10. The notification board of claim 1, wherein a retention space adapted to receive one or more documents is formed between each of said one or more divider sections, at least one of said display panels, and one of said one or more display area depressions.

11. The notification board of claim 10, wherein each said retention space further comprises an open top portion formed by a curved portion located at the top of each of said one or more divider sections that forms said retention space.

12. The notification board of claim 1, wherein each of said tension means is configured to place force upon one of said one or more display panels which said tension means is in contact with in a manner that urges one of said display panel towards a closed position.

13. The notification board of claim 12, wherein said tension means is configured to allow opposing force to be applied thereto in order to move said display panel towards an open position.

14. The notification board of claim 13, wherein contents located behind said display panel may be removed from a bottom side of said divider sections when said display panel is in said open position.

15. A notification board, said notification board comprising:

a back frame portion comprising a front side formed with one or more display area depressions and a rear side that is configured to be affixed to an attachment surface;

a front frame portion comprising one or more divider sections, wherein said front frame portion is connected to said front side of said back frame portion;

one or more display panels each of which are configured with one or more finger slot cut-outs, wherein said one or more display panels are substantially transparent and secured between one of said one or more divider sections of said front frame portion and said front side of said back frame portion; and one or more tension means, wherein each of said one or more tension means is in contact with at least one of said one or more display panels and at least one of said one or more divider sections.

16. The notification board of claim 15, further comprising one or more finger slot depressions that are formed in each of said one or more display area depressions.

17. The notification board of claim 16, wherein said each of one of said one or more finger slot depressions correspond to one of said one or more finger slot cut-outs.

18. A notification board, said notification board comprising:

a back frame portion comprising a front side formed with one or more display area depressions, a rear side that is configured to be affixed to an attachment surface, and one or more finger slot depressions that are formed in each of said one or more display area depressions;

a front frame portion comprising one or more divider sections, wherein said front frame portion is connected to said front side of said back frame portion;

one or more display panels each of which are configured with one or more finger slot cut-outs, wherein said one or more display panels are substantially transparent and secured between one of said one or more divider sections of said front frame portion and said front side of said back frame portion; and one or more tension means, wherein each of said one or more tension means is in contact with at least one of said one or more display panels and at least one of said one or more divider sections.

* * * * *